US009092015B2

(12) United States Patent
Kato et al.

(10) Patent No.: US 9,092,015 B2
(45) Date of Patent: Jul. 28, 2015

(54) ELECTRONIC TIMEPIECE

(71) Applicant: Seiko Instruments Inc., Chiba (JP)

(72) Inventors: Kazuo Kato, Chiba (JP); Akira Takakura, Chiba (JP); Tomohiro Ihashi, Chiba (JP); Takanori Hasegawa, Chiba (JP); Toshitaka Fukushima, Chiba (JP)

(73) Assignee: SEIKO INSTRUMENTS INC. (JP)

( * ) Notice: Subject to any disclaimer, the term of this patent is extended or adjusted under 35 U.S.C. 154(b) by 381 days.

(21) Appl. No.: 13/738,073

(22) Filed: Jan. 10, 2013

(65) Prior Publication Data

US 2013/0194898 A1 Aug. 1, 2013

(30) Foreign Application Priority Data

Jan. 30, 2012 (JP) ..... 2012-017051

(51) Int. Cl.
*G04G 19/12* (2006.01)
*G04G 19/06* (2006.01)

(52) U.S. Cl.
CPC ..... *G04G 19/06* (2013.01); *G04G 19/12* (2013.01)

(58) Field of Classification Search
CPC ..... G04C 10/02; G04C 10/04; G04G 19/12; G04G 19/06
USPC ..... 368/203–205, 66
See application file for complete search history.

(56) References Cited

U.S. PATENT DOCUMENTS

| | | | | |
|---|---|---|---|---|
| 4,763,310 | A * | 8/1988 | Goetzberger | 368/205 |
| 4,764,910 | A * | 8/1988 | Ichikawa | 368/69 |
| 6,424,600 | B1 * | 7/2002 | Okeya et al. | 368/204 |
| 6,636,459 | B1 * | 10/2003 | Nagata | 368/204 |
| 6,643,223 | B2 * | 11/2003 | Fujisawa | 368/204 |
| 2002/0172100 | A1 * | 11/2002 | Igarashi | 368/204 |
| 2006/0114750 | A1 * | 6/2006 | Iida et al. | 368/67 |
| 2009/0238044 | A1 * | 9/2009 | Satoh et al. | 368/155 |

FOREIGN PATENT DOCUMENTS

| | | |
|---|---|---|
| JP | 61077788 | 4/1986 |
| JP | 5697795 | 8/1991 |

* cited by examiner

*Primary Examiner* — Sean Kayes
(74) *Attorney, Agent, or Firm* — Adams & Wilks

(57) ABSTRACT

There is provided an electronic timepiece that includes a solar panel which receives light to generate electric power, is operated with the electric power supplied from a secondary battery charged with output voltage of the solar panel, and includes a normal mode in which clock display is performed on a display unit and a power saving mode in which clock display on the display unit is stopped, based on illuminance detection of the solar panel, the electronic timepiece including: a mode control unit which switches cycles of the illuminance detection, by setting a cycle of the illuminance detection of the normal mode as a first cycle (for example, one minute), and a cycle of the illuminance detection of the power saving mode as a second cycle (for example, two seconds).

16 Claims, 5 Drawing Sheets

ELECTRONIC TIMEPIECE

BACKGROUND OF THE INVENTION

1. Field of the Invention

The present invention relates to an electronic timepiece including a solar panel.

2. Background Art

There is a digital electronic watch with solar cells in the related art (for example, see JP-UM-A-56-97795). The digital electronic watch with solar cells disclosed in JP-UM-A-56-97795 blocks display output from a driver circuit, when output of the solar cells is equal to or less than a predetermined value.

There is an electronic timepiece in the related art (for example, see JP-A-61-77788). A digital electronic watch with solar cells disclosed in JP-A-61-77788 stops a time point display operation when incident light is not continuously obtained for equal to or more than given time.

In an electronic timepiece including a solar panel, it was general to perform an illuminance detection operation of the solar panel every two seconds for improving responsiveness when returning from a power saving mode to a normal mode. However, in both cases of the normal mode and the power saving mode, if the illuminance detection is performed every two seconds, the generated energy of the solar panel is consumed during each illuminance detection and there was a limit on the improvement of the generating efficiency of the solar panel.

In addition, when a state where the generation of electric power is not performed by the solar panel is continued for a given time (for example, 30 minutes to several hours) is detected to transition the electronic timepiece to the power saving mode, in the given time, if the illuminance detection operation is performed every two seconds, electric power which is necessary for the illuminance detection operation is supplied from the secondary battery and the electricity consumption of the secondary battery increases by the same amount. Accordingly, there was also a limit on the improvement of the duration of the secondary battery in a case of the transition to the power saving mode.

SUMMARY OF THE INVENTION

It is an aspect of the present application to provide an electronic timepiece which is capable of reducing the electricity consumed for illuminance detection of a solar panel.

According to another aspect of the application, there is provided an electronic timepiece that includes a solar panel which receives light to generate electric power, is operated with the electric power supplied from a secondary battery charged with output voltage of the solar panel, and includes a normal mode in which the clock display is performed on a display unit and a power saving mode in which clock display on the display unit is stopped, based on illuminance detection of the solar panel, the electronic timepiece including: a control unit which switches cycles of the illuminance detection, by setting a cycle of the illuminance detection of the normal mode as a first cycle, and a cycle of the illuminance detection of the power saving mode as a second cycle which is different from the first cycle.

According to another aspect of the application, in the electronic timepiece, the first cycle of the illuminance detection of the normal mode is longer than the second cycle of the illuminance detection of the power saving mode.

According to another aspect of the application, in the electronic timepiece, in a case of transition from the normal mode to the power saving mode, the control unit performs the illuminance detection with the second cycle in first predetermined time immediately before the transition to the power saving mode.

According to another aspect of the application, in the electronic timepiece, after a state where illuminance which is equal to or more than a predetermined threshold value is not obtained on the solar panel is detected, the control unit performs the illuminance detection of the solar panel with the second cycle in second predetermined time, and the control unit performs the illuminance detection of the solar panel with the first cycle after the second time is elapsed.

According to another aspect of the application, in the electronic timepiece, the electronic timepiece further includes an illuminance detection circuit which performs illuminance detection of the solar panel in a cycle; and a non-illuminance time detection unit which measures non-illuminance duration time in which the illuminance is not obtained on the solar panel based on a detection result of the illuminance of the illuminance detection circuit, and the control unit controls cycles of the illuminance detection of the illuminance detection circuit, compares the non-illuminance duration time with predetermined transition time, and transitions the electronic timepiece from the normal mode to the power saving mode when the non-illuminance duration time surpasses the transition time.

According to the application, it is possible to switch the cycles of the illuminance detection of the solar panel according to each operation mode of the normal mode and the power saving mode. Accordingly, it is possible to provide an electronic timepiece capable of reducing the electricity consumed for the illuminance detection of the solar panel.

DETAILED DESCRIPTION OF THE INVENTION

Hereinafter, the embodiments of the present invention will be described with reference to the drawings.

First Embodiment

Description of General Configuration

Figure 1A:
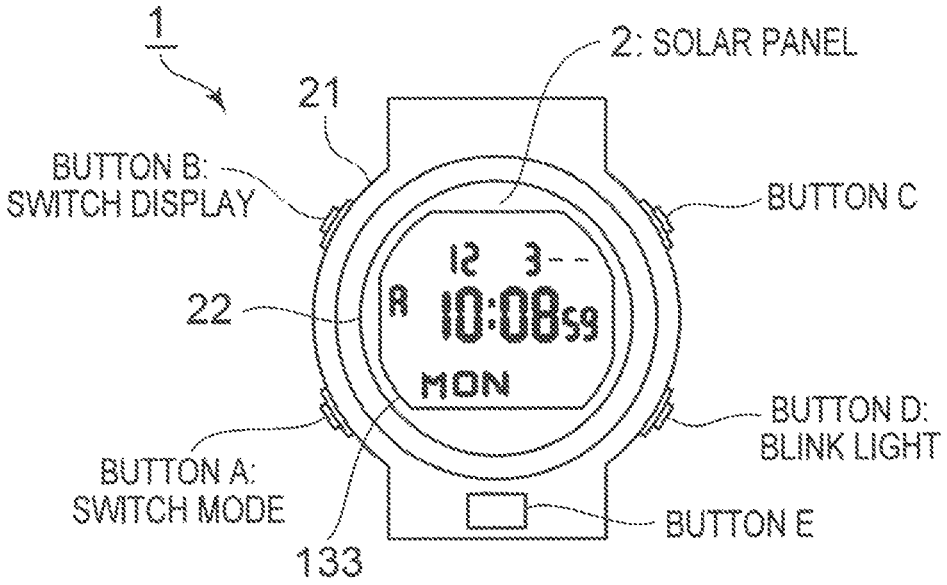
FIGS. 1A to 1C are diagrams showing a general configuration of an electronic timepiece.
Figure 1B:
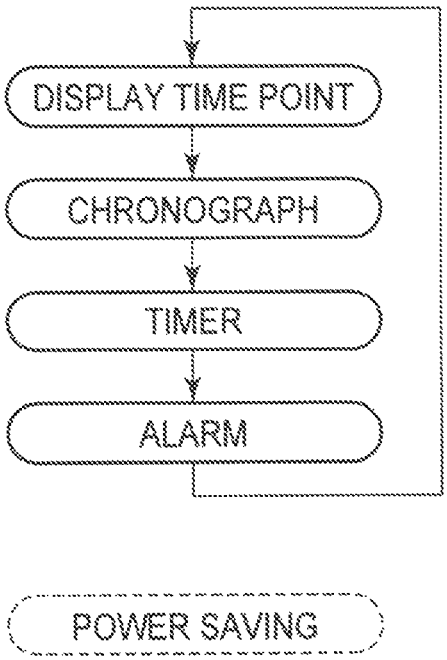
Figure 1C:
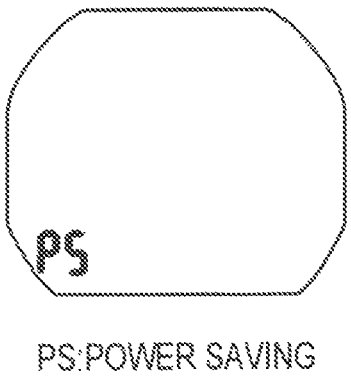

FIGS. 1A to 1C are diagrams showing a general configuration of an electronic timepiece according to the embodiment of the present invention.

As shown in FIGS. 1A to 1C, an electronic timepiece 1 of the embodiment includes a main body case 21, and an LCD (liquid crystal display) 133 and a solar panel 2 are provided under a transparent plate 22 such as windshield glass in a rectangular shape with four corners in a front surface side of the main body case 21. The LCD 133 is provided in the center of the transparent plate 22. The solar panel 2 is disposed on a periphery portion of the transparent plate 22 so as to surround the LCD 133 in a plan view.

In addition, a manipulation button A, a manipulation button B, a manipulation button C, and a manipulation button D which can be manipulated by a user are provided on side surfaces of the main body case 21. Further, a manipulation button E is provided on the surface of the main body case 21.

The manipulation button A outputs a mode change signal which is a signal for changing the operation mode of the electronic timepiece 1. Whenever the manipulation button A is pressed, the mode change signal is output to a mode control unit 103 (see FIG. 2) in a CPU 101 which will be described later. As shown in FIG. 1B, the mode control unit 103 responds to the mode change signal to transition the electronic timepiece 1 to a time point display mode, a chronograph mode, a timer mode, and an alarm mode in this order. In addition, the mode control unit 103 transitions the electronic timepiece 1 to the power saving mode under predetermined conditions which will be described later.

Herein, the time point display mode is a mode in which normal time point display is performed, and as shown in FIG. 1A, date, current time, and day are displayed on the LCD 133, for example.

The chronograph mode is a mode used for time measurement and display of a record in sporting event or the like, and is a mode in which lap time or split time is measured to be displayed, for example.

The timer mode is a mode in which a timer time is set in advance in the timer, the time is measured by counting down the time set in this timer, and an alarm sound is sounded at a count of zero. In addition, the alarm mode is a mode in which the time point is set in advance, and an alarm sound is sounded when the measured time point becomes the set time point.

The power saving mode is a mode for turning off the display of the LCD 133 in order to prevent a wasteful amount of electricity consumption of the secondary battery, when a state where light is not incident to the solar panel 2 is continued for a given time or more. In this power saving mode, the electronic timepiece 1 displays only "PS" on the LCD 133 as shown in FIG. 1C. In addition, other than the operation mode described above, there are cases where the operation mode includes, for example, a world time display mode (mode in which the time point of major cities of the world is displayed), a re-call mode (function for calling the measured data), or the like.

The manipulation button B is a switching button for display, and is a button for performing switching of display of the lap time (LAP) and the split time (SPL), in the chronograph mode (time measurement mode), for example.

The manipulation button C is a start/stop button, and is a button for indicating the start and the end of the time measurement operation in the chronograph mode, for example.

The manipulation button D is a button with a blinking light (internal illumination), and when the manipulation button D is pressed, for example, an electroluminescence (EL) panel used as a light emits light.

The manipulation button E is a button for holding the lap time (LAP) and resetting a measurement value in the chronograph mode, for example.

Internal Configuration of Electronic Timepiece 1

Figure 2:
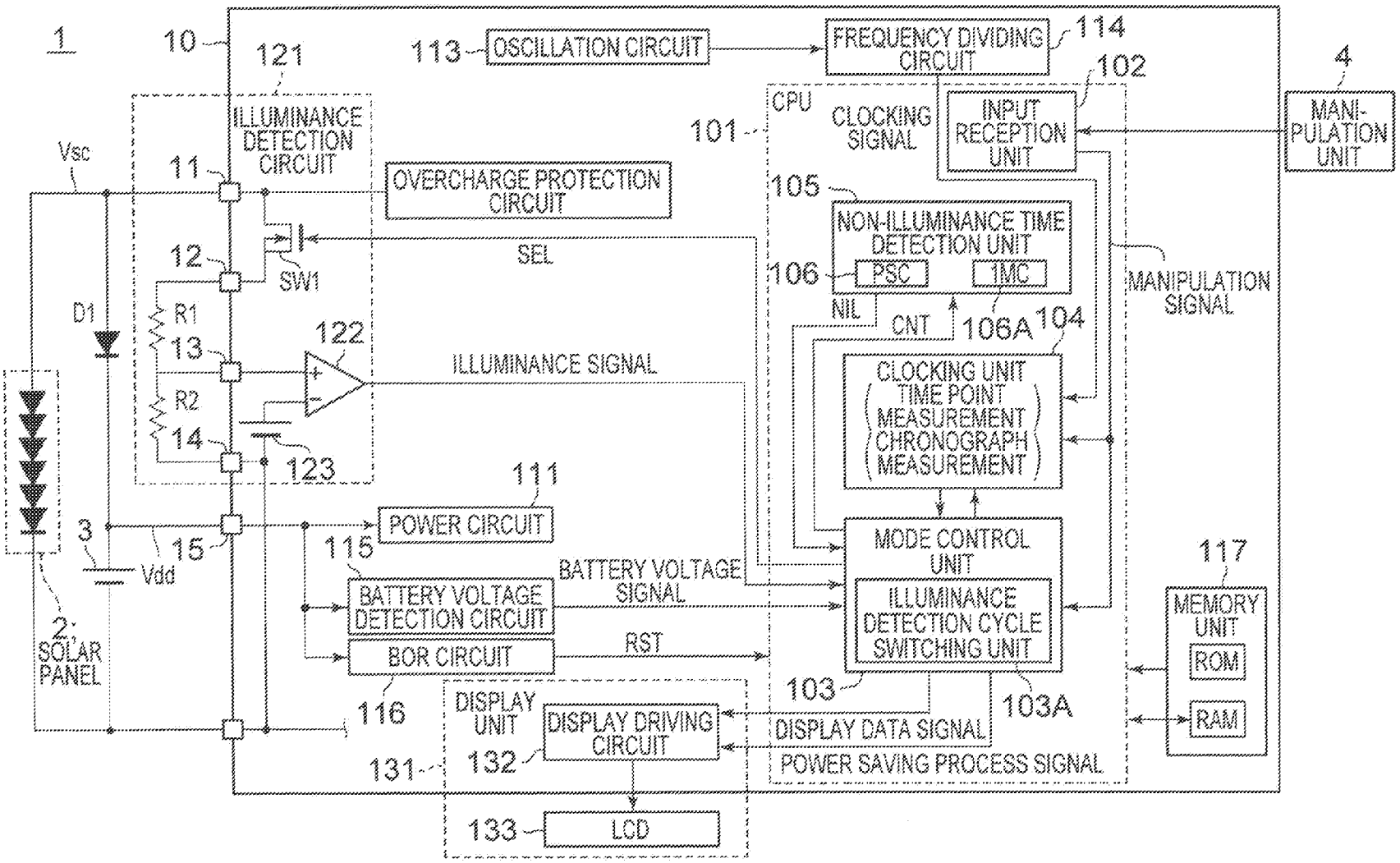
FIG. 2 is a block diagram showing an internal configuration of an electronic timepiece.

FIG. 2 is a block diagram showing an internal configuration of the electronic timepiece according to the embodiment, and shows an example of the electronic timepiece including the solar panel 2. The configuration of the electronic timepiece 1 shown in FIG. 2 is a configuration which is commonly used for the electronic timepiece of the first embodiment and the electronic timepiece of second and third embodiments which will be described later. However, in FIG. 2, a one-minute counter (1MC) 106A of a non-illuminance time detection unit 105 of the CPU 101 is used only in the second and third embodiments.

As shown in FIG. 2, the electronic timepiece 1 includes an integrated circuit (IC) 10, the solar panel 2 configured of a plurality of solar cells, a diode D1, and a secondary battery 3. In addition, the electronic timepiece 1 includes a resistor R1, a resistor R2, the LCD 133, and a manipulation unit 4.

The electronic timepiece 1 performs an operation for performing time point display on the LCD 133 using the power-supply voltage Vdd supplied from the solar panel 2 through the secondary battery 3, and performs an illuminance detection operation for detecting whether or not an electromotive voltage Vsc of the solar panel 2 is sufficient voltage, in a cycle. Then, the electronic timepiece 1 is configured to switch illuminance detection cycles of the solar panel 2 between a normal mode (for example, time point display mode) and a power saving mode.

Hereinafter, each unit configuring the electronic timepiece 1 will be described in detail.

The solar panel 2 is configured of the plurality of solar cells, and charges the secondary battery 3 with the electromotive voltage Vsc (output voltage) of the solar panel 2. Each unit of the electronic timepiece 1 is operated with the power-supply voltage Vdd supplied from the solar panel 2 through the secondary battery 3, and various kinds of display such as time point display are performed on the LCD 133.

In addition, the manipulation unit 4 is configured of a plurality of manipulation buttons (see FIG. 1A) which can be manipulated by a user. In the manipulation unit 4, by performing the button manipulation by a user, a signal according to the button manipulation is input to the input reception unit 102 in the CPU 101. By manipulating the manipulation buttons of the manipulation unit 4, the user can perform switching of operation mode, switching of display contents, adjustment of the time point, and various other settings in the electronic timepiece 1.

The integrated circuit 10 includes the CPU (Central Processing Unit) 101, a power circuit 111, an overcharge protection circuit 112, an oscillation circuit 113, a frequency dividing circuit 114, a battery voltage detection circuit 115, a BOR circuit 116, a memory unit 117, an illuminance detection circuit 121, and the display unit 131.

The power circuit 111 is connected to the secondary battery 3 through a supply terminal 15, generates internal operation voltage of each circuit of the internal portion of the integrated circuit 10 based on the output voltage Vdd of the secondary battery 3, and supplies the generated internal operation voltage to each circuit.

The overcharge protection circuit 112 is connected to an anode side electrode of the solar panel 2 through a terminal 11, and when the secondary battery voltage Vdd is equal to or more than a preset voltage level (for example, 2.6 V), an internal switch (not shown in FIG. 2) which is connected to ground level is turned on, for example. Since the overcharge protection circuit 112 discharges the voltage of the electromotive voltage Vsc of the solar panel 2 so that the charged voltage applied to the secondary battery 3 does not exceed the preset voltage, degradation due to overcharging of the secondary battery 3 is prevented.

The oscillation circuit 113 generates a reference signal to output with respect to the frequency dividing circuit 114. The frequency dividing circuit 114 divides frequency of the input reference signal, and generates a plurality of frequency signals, to output the signal with respect to a clocking unit 104 and the mode control unit 103 in the CPU 101 as clocking signals.

The battery voltage detection circuit 115 is a circuit for detecting the output voltage Vdd of the secondary battery 3, converts a voltage value of the output voltage Vdd of the secondary battery 3 into a digital signal, and outputs the digital signal to the mode control unit 103 in the CPU 101 as a battery voltage signal. This battery voltage signal is used for remaining battery level display, for example.

The BOR circuit 116 is a brown-out reset circuit, and is a circuit which generates a reset signal RST to output to the CPU 101 when the secondary battery voltage Vdd is equal to or less than the predetermined voltage.

The memory unit 117 is configured of a ROM (Read Only Memory) and a RAM (Random Access Memory). A process relating to the process performed in the electronic timepiece 1 is stored in a program format in the ROM, and by reading out and executing the program by the CPU 101, each process necessary for the electronic timepiece 1 is performed. In addition, the RAM is used as an operating memory when the CPU 101 executes a process. In addition, various kinds of measurement data measured in the electronic timepiece are stored and held in the memory unit 117. For example, the memory unit 117 stores data such as a lap time or split time measured by the time measurement operation in the chronograph mode. In addition, the memory unit 117 stores information of a predetermined transition time (in the embodiment, 30 minutes) to the power saving mode therein. The transition time can be manually set by manipulating the manipulation buttons of the manipulation unit 4 by a user. For example, the transition time can be set in a range of 30 minutes to four hours, and can also be set to an arbitrary time equal to or more than four hours.

In addition, the integrated circuit 10 includes an illuminance detection circuit 121. The illuminance detection circuit 121 includes a switch SW1. This SW1 is a switch configured of an n-type MOSFET (Metal-Oxide-Semiconductor Field-Effect Transistor), for example. In the switch SW1, a drain, a source, and a gate are connected to the terminal 11 (a terminal connected to the anode side electrode of the solar panel 2), a terminal 12, and the mode control unit 103 in the CPU 101, respectively. The mode control unit 103 outputs a selection signal SEL in a low level (L level) in the normal operation of the electronic timepiece 1 to agate of the switch SW1, and turns off the switch SW1. Meanwhile, in the illuminance detection of the solar panel 2, the mode control unit 103 sets the selection signal SEL to be in a high level (H level) and turns on the switch SW1.

In addition, other than the switch SW1, the illuminance detection circuit 121 includes a comparator 122, a reference voltage generation circuit 123 (reference voltage source), and a voltage-dividing circuit configured of the resistor R1 and the resistor R2. The resistor R1 and the resistor R2 are connected between the terminal 12 and a terminal 13, and between the terminal 13 and a ground terminal 14, respectively. In the embodiment, the resistor R1 and the resistor R2 are provided on the outer portion of the integrated circuit 10, however they maybe provided on the inner portion of the integrated circuit 10.

In the comparator 122, a normal input terminal is connected to the terminal 13, and an inverting input terminal is connected to the positive (+) side output of the reference voltage generation circuit 123.

The reference voltage generation circuit 123 generates a reference voltage in a case of determination performed by the comparator 122, according to the voltage supplied from the power circuit 111. The comparator 122 is activated by the mode control unit 103 in the illuminance detection, and an illuminance signal in H level is output when the voltage of the terminal 13 is higher than the output voltage (reference voltage Vref) of the reference voltage generation circuit 123. In addition, when the voltage of the terminal 13 is lower than the reference voltage Vref, the comparator 122 outputs the illuminance signal in L level. The illuminance signal is output with respect to the mode control unit 103 in the CPU 101.

In the embodiment, for example, the resistance ratio of the resistor R1 and the resistor R2 is 2:1, and the reference voltage Vref is set to be 1.2 V.

The display unit 131 is configured of a display driving circuit 132 and the LCD 133.

The display driving circuit 132 receives a display data signal according to each operation mode (for example, a time point display mode or chronograph mode) from the mode control unit 103 in the CPU 101, and outputs the display data signal to the LCD 133. For example, in a case of the time point display mode, the display driving circuit 132 receives the display data signal corresponding to the time point measurement data from the mode control unit 103, and displays the display data signal on the LCD 133. In addition, for example, in a case of the chronograph mode, the display driving circuit 132 receives the display data signal corresponding to the chronograph measurement data from the mode control unit 103, and displays the display data signal on the LCD 133.

In addition, when the electronic timepiece 1 transitions to the power saving mode and a power saving process signal is output from the mode control unit 103, the display driving circuit 132 turns off the display of the LCD 133. When the display of the LCD 133 is turned off in the power saving mode, the display driving circuit 132 displays display showing the power saving state (for example, text display "PS" shown in FIG. 1C) on the LCD 133.

The LCD 133 configured of a liquid crystal panel performs display according to the display data output from the display driving circuit 132, for example, display of each mode, time point display, and display of measured time, turns off the time point display when performing power saving, and performs a display showing a power saving state.

In addition, the input reception unit 102 in the CPU 101 receives a signal of the button manipulation input from the manipulation unit 4 as an external interruption request signal, holds that the button manipulation in the manipulation unit 4 is performed and contents thereof in a register (not shown), and outputs a manipulation signal according to the contents of the button manipulation to each unit in the CPU 101. For example, since the operation mode of the electronic timepiece 1 changes, the input reception unit 102 outputs the mode change signal from the manipulation unit 4 to the mode control unit 103 as the manipulation signal. In addition, the input reception unit 102 outputs the manipulation signal for performing adjustment of the time point or various other settings in the clocking unit 104 with respect to the clocking unit 104. The input reception unit 102 outputs a button manipulation signal indicating whether or not the button manipulation is performed in the manipulation unit 4, to the mode control unit 103.

The mode control unit 103 responds to a manipulation signal (for example, manipulation signal corresponding to the mode change signal from the manipulation unit 4) output from the manipulation unit 4, to set the operation mode of the electronic timepiece 1. In addition, the mode control unit 103 controls the operations of the clocking unit 104, the non-illuminance time detection unit 105, the illuminance detection circuit 121, and the display unit 131, according to the operation mode of the electronic timepiece 1.

For example, the mode control unit 103 outputs a counting signal CNT with respect to the non-illuminance time detection unit 105, performs time counting using a power saving counter (PSC) 106 and the one-minute counter (1MC) 106A in the non-illuminance time detection unit 105, and resets the counted value. The counted value of the power saving counter (PSC) 106 and the one-minute counter (1MC) 106A is output with respect to the mode control unit 103 as a signal showing a non-illuminance duration time NIL (time in which a state where the illuminance is not obtained on the solar panel 2 is continued).

In addition, the mode control unit 103 receives the time point measurement data and the time measurement data from the clocking unit 104, and generates a display data signal according to the set operation mode to output with respect to the display driving circuit 132.

In addition, the mode control unit 103 receives a signal showing non-illuminance duration time NIL from the non-illuminance time detection unit 105 and compares with a predetermined transition time (for example, 30 minutes). Then, when it is determined that the non-illuminance duration time NIL surpasses predetermined transition time, the mode control unit 103 transitions the electronic timepiece 1 to the power saving mode, and outputs a power saving process signal for turning off the display of the LCD 133 with respect to the display driving circuit 132.

In addition, the mode control unit 103 includes an illuminance detection cycle switching unit 103A. The illuminance detection cycle switching unit 103A is a processing unit for generating the selection signal SEL which activates or deactivates the illuminance detection circuit 121. The illuminance detection cycle switching unit 103A includes a function of switching cycles of the illuminance detection, by setting the cycle of the illuminance detection of the normal mode as one minute (first cycle), and the cycle of the illuminance detection of the power saving mode as two seconds (second cycle). The mode control unit 103 outputs the selection signal SEL generated by the illuminance detection cycle switching unit 103A to the illuminance detection circuit 121.

The clocking unit 104 performs time point measurement by counting number of clocking signals input from the frequency dividing circuit 114, and generates time point measurement data which is a signal showing the time point. In addition, in the chronograph mode, the clocking unit 104 performs the time measurement operation by counting number of the clocking signals input from the frequency dividing circuit 114, and generates time measurement data. The time point measurement data and the time measurement data generated in the clocking unit 104 are output to the mode control unit 103. The time point measurement data and the time measurement data are output to the display driving circuit 132 through the mode control unit 103 as display data signals. For example, in a case of the time point display mode, the mode control unit 103 outputs the time point measurement data to the display driving circuit 132 as the display data signal.

The non-illuminance time detection unit 105 counts the non-illuminance duration time NIL according to the counting signal CNT input from the mode control unit 103 by the power saving counter (PSC) 106 which counts in minute units and the one-minute counter (1MC) 106A which counts in second units.

For example, in a case where the counting signal CNT is a signal indicating to increment (add +1) the power saving counter 106, the non-illuminance time detection unit 105 increments the power saving counter 106. In addition, for example, in a case where the counting signal CNT is a signal indicating to add +2 to the one-minute counter 106A, +2 is added to the one-minute counter 106A. Further, for example, in a case where the counting signal CNT is a signal indicating the counter reset, the counted values of the power saving counter 106 and the one-minute counter 106A are reset, respectively.

The non-illuminance time detection unit 105 outputs the counted values of the counters 106 and 106A with respect to the mode control unit 103 as the signal showing the non-illuminance duration time NIL.

The one-minute counter (1MC) 106A is not used in the first embodiment, but is used in the second and third embodiments which will be described later. In the first embodiment, the non-illuminance duration time NIL is counted using the power saving counter 106, and in the second and third embodiments, the non-illuminance duration time NIL is counted using both the power saving counter (PSC) 106 and the one-minute counter (1MC) 106A.

In the electronic timepiece 1 configured as described above, by manipulating the manipulation unit 4, for example, the manipulation button A (see FIGS. 1A to 1C) by a user, the manipulation signal (in this case, the manipulation signal corresponding to the mode change signal from the manipulation unit 4) for changing the operation mode of the electronic timepiece 1 and the display state of the LCD 133 is output to the mode control unit 103. The mode control unit 103 responds to the manipulation signal corresponding to the mode change signal to change the operation mode of the electronic timepiece 1.

In the time point display mode, the clocking unit 104 counts the clocking signals output from the frequency dividing circuit 114 to generate the time point measurement data showing the time point, and outputs the time point measurement data to the mode control unit 103. In addition, in the chronograph mode, the clocking unit 104 counts the clocking signals output from the frequency dividing circuit 114 to generate the time measurement data, and outputs the signal of the time measurement data to the mode control unit 103.

When the electronic timepiece 1 is set to be in the time point display mode, the mode control unit 103 outputs the display data signal including the time point measurement data to the display driving circuit 132. The display driving circuit 132 converts the time point measurement data into a format suitable to be displayed and outputs it to the LCD 133, and the LCD 133 digitally displays the time point corresponding to the time point measurement data.

In addition, when the electronic timepiece 1 is set to be in the chronograph mode, the mode control unit 103 outputs the display data signal including the time measurement data to the display driving circuit 132. The display driving circuit 132 converts the time measurement data into a format suitable to be displayed and outputs it to the LCD 133, and the LCD 133 digitally displays the time point corresponding to the time measurement data.

The non-illuminance time detection unit 105 receives the counting signal CNT output from the mode control unit 103, and counts the non-illuminance duration time NIL in which a state where the light is not obtained on the solar panel is continued by the power saving counter (PSC) 106 and the one-minute counter 106A. The non-illuminance time detection unit 105 outputs the signal showing the non-illuminance duration time NIL with respect to the mode control unit 103.

The mode control unit 103 receives the counted values of the counters 106 and 106A from the non-illuminance time detection unit 105 as the signal showing the non-illuminance duration time NIL, and compares the non-illuminance duration time NIL with a predetermined transition time (for example, 30 minutes). Then, when the non-illuminance duration time NIL surpasses predetermined transition time (for example, 30 minutes), the mode control unit 103 transitions the electronic timepiece 1 to the power saving mode, and outputs a power saving process signal for turning off the display of the LCD 133 with respect to the display driving circuit 132.

Description of Transition Operation between Normal Mode and Power Saving Mode

Next, the transition operation between the normal mode and the power saving mode of the electronic timepiece 1 of the embodiment will be described.

As described above, when a state where the illuminance is not obtained on the solar panel 2 is continued for a given time, the electronic timepiece 1 transitions to the power saving mode to avoid the unnecessary amount of electricity consumption of the secondary battery 3. In this case, after the illuminance is not obtained on the solar panel 2, the electronic timepiece 1 operates in the normal mode until transition to the power saving mode, and the illuminance detection of the solar panel 2 is performed for every minute in the normal mode. Then, after the transition to the power saving mode, the electronic timepiece 1 performs the illuminance detection of the solar panel 2 every two seconds.

Figure 3A:
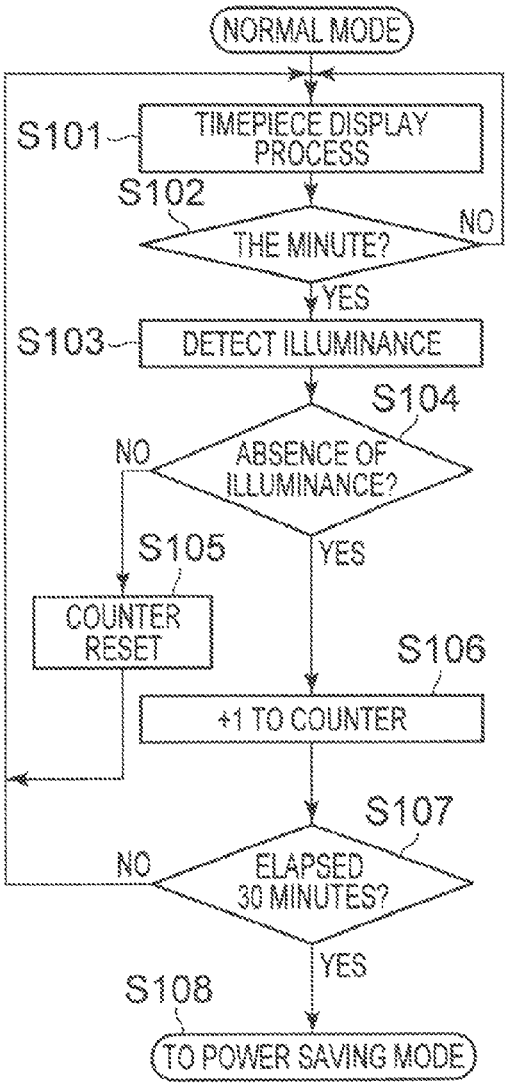
FIGS. 3A and 3B are flowcharts illustrating transition operations between a normal mode and a power saving mode of an electronic timepiece of a first embodiment.
Figure 3B:
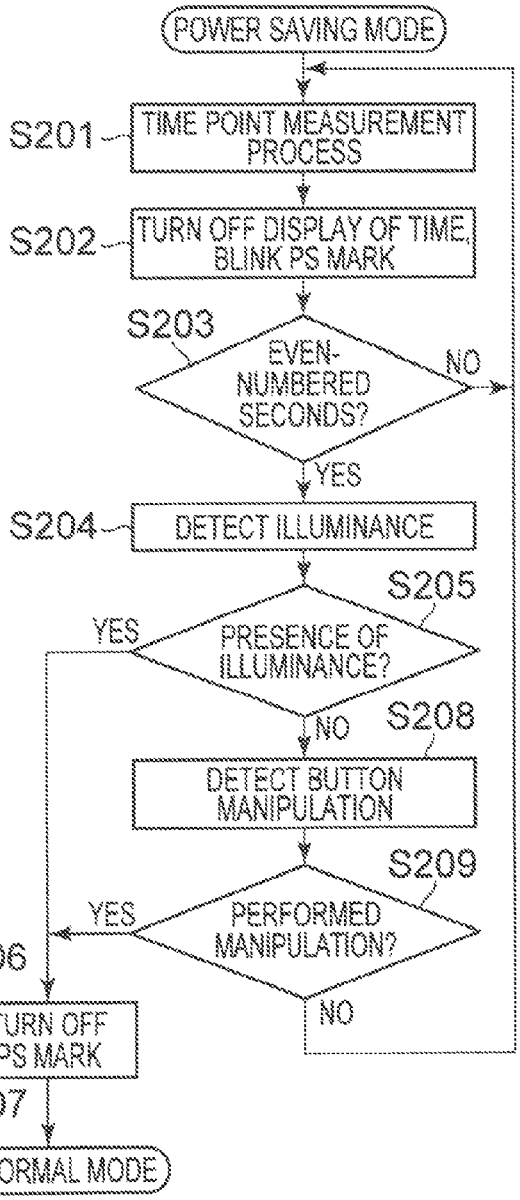

FIGS. 3A and 3B are flowcharts illustrating the transition operations between the normal mode and the power saving mode of the electronic timepiece 1. FIG. 3A shows a flow of a process in a case of the transition from the normal mode to the power saving mode, and FIG. 3B shows a flow of a process in a case of the transition from the power saving mode to the normal mode.

First, the flow of the process in a case of the transition from the normal mode to the power saving mode will be described with reference to FIG. 3A. The process shown in FIG. 3A is a process performed by being repeated every minute in the CPU 101 (mainly mode control unit 103), and in the normal mode, the power saving counter (PSC) 106 for measuring light shielding time of the solar panel 2 is initialized (reset) to zero. In this process, the one-minute counter (1MC) 106A in the non-illuminance time detection unit 105 is not used.

With reference to FIG. 3A, in the normal mode, the mode control unit 103 performs a time point measurement process of the clocking unit 104 and a timepiece display process of the display unit 131 (step S101). Then, the mode control unit 103 determines whether or not the current time point is the minute (in minute units, 00 second 00) based on the time point measurement data measured in the clocking unit 104 (step S102). When it is determined that the current time point is not the minute in the process of step S102 (step S102; No), the mode control unit 103 returns to the process of step S101 and continues the time point measurement process of the clocking unit 104 and the timepiece display process of the display unit 131.

When it is determined that the time point is the minute in the process of step S102 (step S102; Yes), the mode control unit 103 turns on the illuminance detection (step S103). That is, the mode control unit 103 turns on to activate the SW1 in the illuminance detection circuit 121, and outputs the illuminance signal from the illuminance detection circuit 121. The illuminance signal is output with respect to the mode control unit 103.

Next, the process proceeds to a process of step S104, and the mode control unit 103 determines whether or not the solar panel 2 is in a state of "absence of illuminance", based on the illuminance signal input from the illuminance detection circuit 121 (step S104).

When it is determined as "presence of illuminance" in the process of step S104 (step S104; No), the mode control unit 103 outputs the counting signal CNT indicating the counter reset with respect to the non-illuminance time detection unit 105, and initializes (resets) the counted value of the power saving counter 106 in the non-illuminance time detection unit 105 (step S105). In addition, at that time, the mode control unit 103 turns off the illuminance detection, that is, deactivates (turns off the switch SW1) the illuminance detection circuit 121, and stops the output of the illuminance signal.

The process returns to step S101 after the process of step S105, and the mode control unit 103 continues the time point measurement process of the clocking unit 104 and the timepiece display process of the display unit 131.

Meanwhile, when it is determined as "absence of illuminance" in the process of step S104 (step S104; Yes), the mode control unit 103 outputs the counting signal CNT indicating the counted number with respect to the non-illuminance time detection unit 105, and increments (adds +1) the counted value of the power saving counter 106 in the non-illuminance time detection unit 105 (step S106). The non-illuminance time detection unit 105 outputs the counted value of the power saving counter 106 with respect to the mode control unit 103 as a signal showing the non-illuminance duration time NIL. In addition, at that time, the mode control unit 103 turns off the illuminance detection, that is, deactivates (turns off the switch SW1) the illuminance detection circuit 121, and stops the output of the illuminance signal.

Then, when the signal showing the non-illuminance duration time NIL is input from the non-illuminance time detection unit 105, the mode control unit 103 compares the non-illuminance duration time NIL with the predetermined transition time (in this example, 30 minutes), and determines whether or not the non-illuminance duration time NIL surpasses 30 minutes (step S107). When it is determined that the non-illuminance duration time NIL surpasses 30 minutes in the process of step S107 (step S107; Yes), the mode control unit 103 transitions the electronic timepiece 1 to the power saving mode (step S108).

Meanwhile, when it is determined that the non-illuminance duration time NIL does not elapse 30 minutes in the process of step S107 (step S107; No), the process returns to step S101, and the mode control unit 103 continues the time point measurement process of the clocking unit 104 and the timepiece display process of the display unit 131.

As described above, after the illuminance is not obtained on the solar panel 2, in the normal mode before the transition to the power saving mode, the mode control unit 103 activates the illuminance detection circuit 121 for every minute to perform the illuminance detection of the solar panel 2. Then, when the illuminance is not continuously obtained on the solar panel 2, the mode control unit 103 performs the measurement operation of the non-illuminance duration time NIL by using the power saving counter 106 of the non-illuminance time detection unit 105.

When the non-illuminance duration time NIL is compared with the predetermined transition time (herein, 30 minutes) and it is determined that the illuminance is not continuously obtained on the solar panel 2 for 30 minutes or more, the mode control unit 103 transitions the electronic timepiece 1 to the power saving mode. Accordingly, after the illuminance is not obtained on the solar panel 2, for 30 minutes until the transition to the power saving mode, the electronic timepiece 1 is maintained in the normal mode and activates the illuminance detection circuit 121 every minute to perform the illuminance detection. Thus, the electronic timepiece 1 can reduce the electricity consumption necessary for the illuminance detection.

Next, the flow of a process in a case of the transition from the power saving mode to the normal mode will be described with reference to FIG. 3B. The process shown in FIG. 3B is a process performed by being repeated every two seconds in CPU 101 (mainly, mode control unit 103).

In the power saving mode, the mode control unit 103 performs the time point measurement process in the clocking unit 104 (step S201). Then, the mode control unit 103 turns off the clock display on the LCD 133, that is, stops the clock display, and blinks the PS (power saving) mark (step S202).

Then, the mode control unit 103 determines whether or not the current time point is an even-numbered second, based on the time point measurement data measured in the clocking unit 104 (step S203). When it is determined that the current time point is not an even-numbered second in the process of step S203 (step S203; No), the process returns to the process of step S201, and the mode control unit 103 continues the time point measurement process of the clocking unit 104.

In addition, when it is determined that the current time point is an even-numbered second in the process of step S203 (step S203; Yes), the mode control unit 103 turns on the illuminance detection. That is, the mode control unit 103 turns on and activates the switch SW1 in the illuminance detection circuit 121, and outputs the illuminance signal from the illuminance detection circuit 121 (step S204).

Then, the process proceeds to step S205, and the mode control unit 103 determines whether or not the illuminance is obtained on the solar panel 2, based on the illuminance signal input from the illuminance detection circuit 121.

When it is determined as "presence of illuminance" in the process of step S205 (step S205; Yes), the mode control unit 103 turns off the light of the PS mark displayed on the display unit 131 (step S206). In addition, at that time, the mode control unit 103 turns off the illuminance detection. That is, the mode control unit 103 deactivates the illuminance detection circuit 121 and stops the output of the illuminance signal.

After the process of step S206, the mode control unit 103 transitions the electronic timepiece 1 to the normal mode (step S207).

Meanwhile, when it is determined that there is no illuminance in the process of step S205 (step S205; No), the mode control unit 103 turns off the illuminance detection, transitions to the process of step S208, and detects the button manipulation based on the manipulation signal output from the input reception unit 102 (step S208).

Then, the mode control unit 103 determines whether or not the button manipulation (more properly, button manipulation which results in release of the power saving mode) is performed in the manipulation unit 4 (step S209). Then, when it is determined that the button manipulation is performed (step S209; Yes), the mode control unit 103 turns off the PS mark displayed on the display unit 131 (step S206) and transitions the electronic timepiece 1 to the normal mode (step S207).

Meanwhile, when it is determined that the button manipulation is not performed in the process of step S209 (step S209; No), the process returns to the process of step S201, and the mode control unit 103 continues the measurement process of the clocking unit 104.

As described above, in the state of the transition of the electronic timepiece 1 to the power saving mode, the mode control unit 103 performs the illuminance detection of the solar panel 2 every two seconds. Then, when any one of the state where the illuminance to the solar panel 2 is obtained and the state where the button manipulation is performed in the manipulation unit 4, is detected, the mode control unit 103 transitions the electronic timepiece 1 from the power saving mode to the normal mode.

Accordingly, in the case where the electronic timepiece 1 is in a state of the power saving mode, when the illuminance is obtained on the solar panel 2 or the button manipulation is performed, the mode control unit 103 can rapidly return the electronic timepiece 1 to the normal mode.

Second Embodiment

In the electronic timepiece 1 of the first embodiment, after the illuminance is not obtained on the solar panel 2, for 30 minutes until the transition to the power saving mode, the normal mode is maintained, and the illuminance detection circuit 121 is activated to perform the illuminance detection every minute.

On the other hand, in the electronic timepiece 1 of the second embodiment, after the illuminance is not obtained on the solar panel 2, for 30 minutes until the transition to the power saving mode, the illuminance detection is performed every minute for the first 29 minutes, and the illuminance detection is performed every two seconds for the final minute from 29 minutes to 30 minutes.

As described above, by performing the illuminance detection every two seconds in one minute directly before the transition to the power saving mode, the electronic timepiece 1 of the second embodiment repeatedly checks for whether or not the illuminance is obtained on the solar panel 2 with high responsiveness.

For example, the electronic timepiece 1 is beneath a shirt sleeve. After 29 minutes has elapsed, and in a case where a user checks the time taking the electronic timepiece from beneath the sleeve in the last one minute immediately before entering the power saving mode, and then returns the electronic timepiece to beneath the sleeve again, the electronic timepiece 1 directly enters the power saving mode. In the case described above, when the user tries to check the time taking the electronic timepiece from beneath the sleeve again, the clock display is turned off at this time, and the user may feel it unusual and think "I just checked the time a moment ago, why is it that this time my watch display is blank?". The electronic timepiece of the second embodiment avoids causing a feeling of unusualness in the user.

Figure 4:
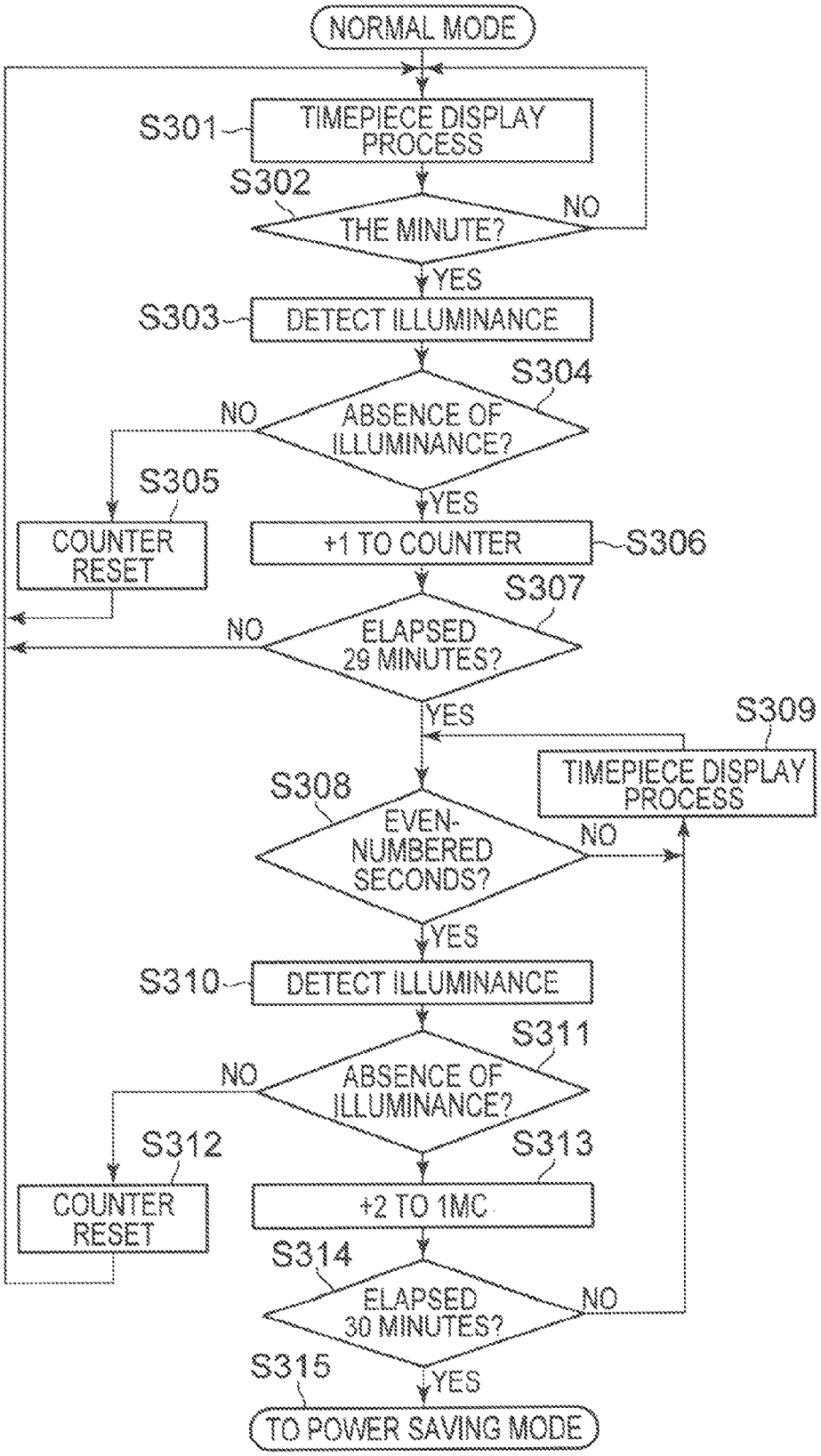
FIG. 4 is a flowchart illustrating transition operations from a normal mode to a power saving mode of an electronic timepiece of a second embodiment.

FIG. 4 is a flowchart illustrating the transition operation of the electronic timepiece of the second embodiment from the normal mode to the power saving mode. In addition, the transition operation from the power saving mode to the normal mode is the same as the case of the first embodiment.

A flow of a process in a case of the transition from the normal mode to the power saving mode will be described with reference to FIG. 4. Initially, the power saving counter (PSC) 106 and the one-minute counter (1MC) 106A for measuring the light shielding time of the solar panel 2 is initialized (reset) to zero.

By referring to FIG. 4, in the normal mode, the mode control unit 103 performs the time point measurement process of the clocking unit 104 and the timepiece display process of the display unit 131 (step S301). Then, the mode control unit 103 determines whether or not the current time point is the minute, based on the time point measurement data measured in the clocking unit 104 (step S302).

When it is determined that the time point is not the minute in the process of step S302 (step S302; No), the process returns to the process of step S301, the mode control unit 103 continues the time point measurement process of clocking unit 104 and the timepiece display process of the display unit 131.

When it is determined that the time point is the minute in the process of step S302 (step S302; Yes), the mode control unit 103 turns on the illuminance detection (step S303). That is, the mode control unit 103 activates by turning on the SW1 in the illuminance detection circuit 121, and outputs the illuminance signal from the illuminance detection circuit 121. The illuminance signal is output with respect to the mode control unit 103.

Then, the process proceeds to the process of step S304, and the mode control unit 103 determines whether or not the solar panel 2 is in a state of "absence of illuminance", based on the illuminance signal input from the illuminance detection circuit 121 (step S304).

When it is determined as "presence of illuminance" in the process of step S304 (step S304; No), the mode control unit 103 outputs the counting signal CNT indicating the counter reset with respect to the non-illuminance time detection unit 105 and initializes (resets) the counted value of the power saving counter (PSC) 106 and one-minute counter (1MC) 106A in the non-illuminance time detection unit 105 (step S305). In addition, at that time, the mode control unit 103 deactivates the illuminance detection circuit 121 (turns off the switch SW1), and stops the output of the illuminance signal.

The process proceeds to step S301 after the process of step S305, and the mode control unit 103 continues the time point measurement process of the clocking unit 104 and the timepiece display process of the display unit 131.

Meanwhile, when it is determined as "absence of illuminance" in the process of step S304 (step S304; Yes), the mode control unit 103 outputs the counting signal CNT with respect to the non-illuminance time detection unit 105 and increments (adds +1) the counted value of the power saving counter 106 in the non-illuminance time detection unit 105 (step S306). The non-illuminance time detection unit 105 outputs the counted value of the power saving counter 106 with respect to the mode control unit 103 as a signal showing the non-illuminance duration time NIL. In addition, at that time, the mode control unit 103 deactivates the illuminance detection circuit 121 (turns off the switch SW1), and stops the output of the illuminance signal.

Next, when the signal showing the non-illuminance duration time NIL is input from the non-illuminance time detection unit 105, the mode control unit 103 compares the non-illuminance duration time NIL with the predetermined time (in this example, 29 minutes), and determines whether or not the non-illuminance duration time NIL surpasses 29 minutes (step S307).

When it is determined that the non-illuminance duration time NIL is not elapsed 29 minutes in the process of step S307 (step S307; No), the process returns to step S301, and the mode control unit 103 continues the time point measurement process of the clocking unit 104 and the timepiece display process of the display unit 131.

Meanwhile, when it is determined that the non-illuminance duration time NIL exceeds 29 minutes in the process of step S307 (step S307; Yes), the process proceeds to step S308, the mode control unit 103 determines whether or not the current time point is an even-numbered second, based on the time point measurement data measured in the clocking unit 104 (step S308). When it is determined that the current time point is not an even-numbered second in the process of step S308 (step S308; No), the process proceeds to step S309, and the mode control unit 103 continues the time point measurement process of the clocking unit 104 and the time point display process of the display unit 131 (step S309), and after that the process returns to step S308.

When it is determined that the time point is an even-numbered second in the process of step S308 (step S308; Yes), the mode control unit 103 turns on the illuminance detection (step S310). That is, the SW1 in the illuminance detection circuit 121 is turned on to be activated, and the illuminance signal is output from the illuminance detection circuit 121. The illuminance signal is output with respect to the mode control unit 103.

Next, the process proceeds to the process of step S311, and the mode control unit 103 determines whether or not the solar panel 2 is in a state of "absence of illuminance", based on the illuminance signal input from the illuminance detection circuit 121 (step S311).

When it is determined as "presence of illuminance" in the process of step S311 (step S311; No), the mode control unit 103 outputs the counting signal CNT indicating the counter reset with respect to the non-illuminance time detection unit 105 and initializes (resets) the counted values of the power saving counter (PSC) 106 and the one-minute counter (1MC) 106A in the non-illuminance time detection unit 105 (step S312). Next, after turning on the illuminance detection, the process returns to the process of step S301, the mode control unit 103 continues the time point measurement process of the clocking unit 104 and the time point display process of the display unit 131.

Meanwhile, it is determined as "absence of illuminance" in the process of step S311 (step S311; Yes), the mode control unit 103 outputs the counting signal CNT indicating the counted number with respect to the non-illuminance time detection unit 105, and adds +2 (corresponding to two seconds) to the counted value of the one-minute counter 106A in the non-illuminance time detection unit 105 (step S313). The non-illuminance time detection unit 105 outputs the counted value (counted value in second units) of the one-minute counter 106A and the counted value (counted value in minute units) of the power saving counter 106 with respect to the mode control unit 103 as the signal showing the non-illuminance duration time NIL. At that time, the mode control unit 103 turns off the illuminance detection.

When inputting the signal showing the non-illuminance duration time NIL, the mode control unit 103 determines whether or not the non-illuminance duration time NIL surpasses 30 minutes (step S314). Then, in the mode control unit 103, when it is determined that the non-illuminance duration time NIL is not elapsed 30 minutes in the process of step S314 (step S314; No), the process returns to the process of step S309.

Meanwhile, when it is determined that the non-illuminance duration time NIL surpasses 30 minutes in the process of step S314 (step S314; Yes), the mode control unit 103 transitions the electronic timepiece 1 to the power saving mode (step S315).

As described above, after the illuminance is not obtained on the solar panel 2, for 29 minutes, in the same manner as in the case of the normal mode, the mode control unit 103 activates the illuminance detection circuit 121 for every minute to perform the illuminance detection of the solar panel 2. Then, for one minute after 29 minutes are elapsed, the mode control unit 103 activates the illuminance detection circuit 121 every two seconds to perform the illuminance detection of the solar panel 2, and if 30 minutes are elapsed, the mode control unit 103 transitions the electronic timepiece 1 to the power saving mode. Accordingly, when the electricity consumption necessary for the illuminance detection is reduced and the transition to the power saving mode is performed, it is possible to repeatedly and rapidly check for that the illuminance is not obtained on the solar panel 2.

Third Embodiment

In the second embodiment described above, for one minute directly before the transition to the power saving mode, the example in which the illuminance detection of the solar panel 2 is performed every two seconds has been described. On the other hand, in the third embodiment, after the illuminance is not obtained on the solar panel 2, an example in which the illuminance detection of the solar panel 2 is performed every two seconds for the initial one minute, and the illuminance detection is performed every minute after the initial one minute is elapsed, will be described.

This is for avoiding the transition of the electronic timepiece to the power saving mode, when the electronic timepiece is beneath the shirt sleeve. Accordingly, in the electronic timepiece of the third embodiment, the illuminance detection is performed every two seconds in the first one minute after the illuminance is not obtained on the solar panel 2. Accordingly, in the electronic timepiece of the third embodiment, it is possible to start the time measurement for the transition to the power saving mode, after the state where the illuminance is not obtained on the solar panel 2 is precisely detected.

Figure 5:
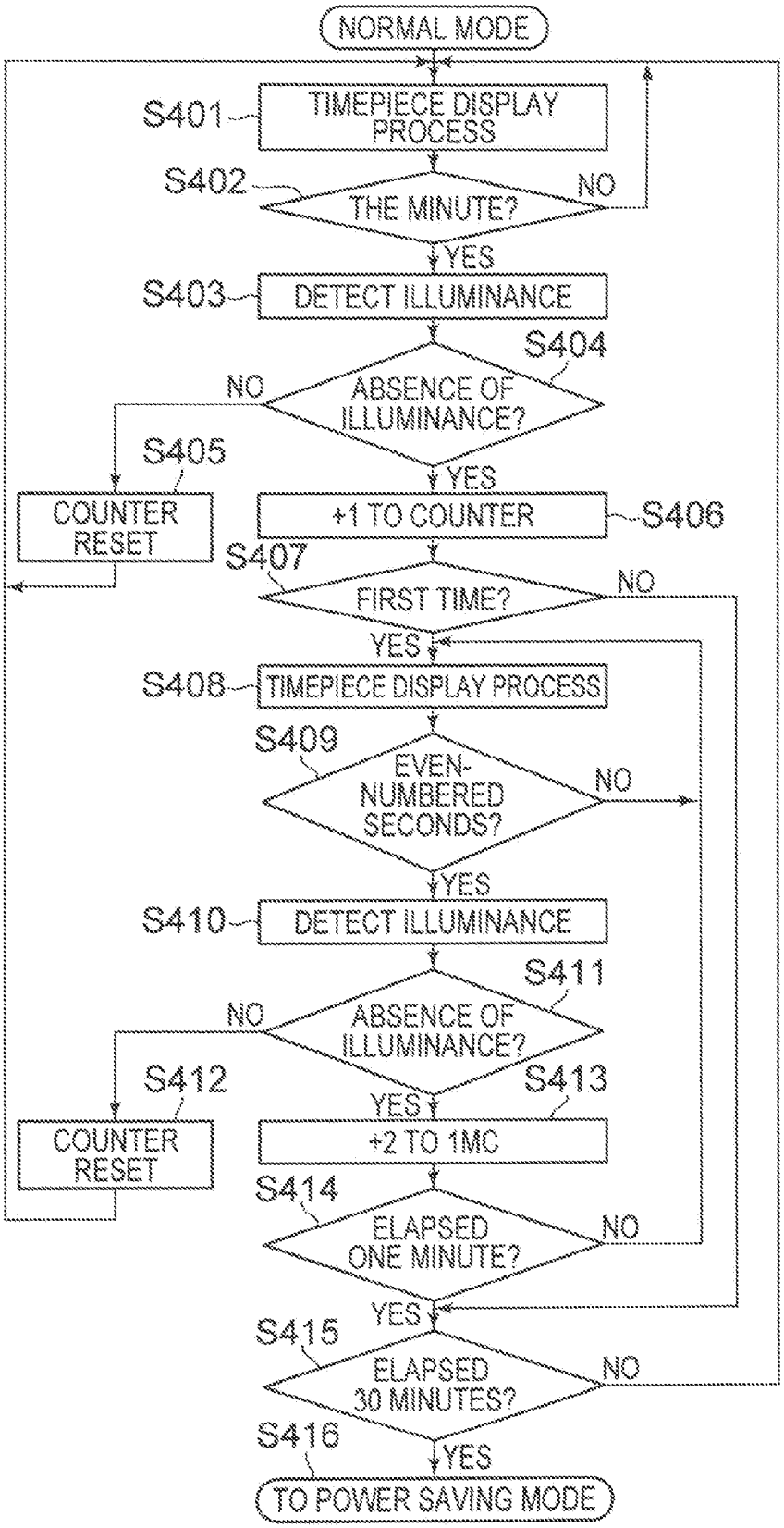
FIG. 5 is a flowchart illustrating transition operations from a normal mode to a power saving mode of an electronic timepiece of a third embodiment.

FIG. 5 is a flowchart illustrating transition operation of the electronic timepiece 1 of the third embodiment from the normal mode to the power saving mode. In addition, the transition operation from the power saving mode to the normal mode is the same as the case of the first embodiment.

A flow of a process of the case of the transition from the normal mode to the power saving mode will be described with reference to FIG. 5. In addition, first, the power saving counter (PSC) 106 and the one-minute counter (1MC) 106A for measuring the light shielding time of the solar panel 2 is initialized (reset) to zero.

By referring to FIG. 5, in the normal mode, the mode control unit 103 performs the time point measurement process of the clocking unit 104 and the timepiece display process of the display unit 131 (step S401). Next, the mode control unit 103 determines whether or not the current time point is the minute, based on the time point measurement data measured in the clocking unit 104 (step S402). When it is determined that the time point is not the minute in the process of step S402 (step S402; No), the process returns to step S401, the mode control unit 103 continues the time point measurement process of the clocking unit 104 and the timepiece display process of the display unit 131.

When it is determined that the time point is the minute in the process of step S402 (step S402; Yes), the mode control unit 103 turns on the illuminance detection (step S403). That is, the mode control unit 103 turns on and activates the SW1 in the illuminance detection circuit 121, and outputs the illuminance signal from the illuminance detection circuit 121. The illuminance signal is output with respect to the mode control unit 103.

Next, the process proceeds to the process of step S404, and the mode control unit 103 determines whether or not the solar panel 2 is in a state of "absence of illuminance", based on the illuminance signal input from the illuminance detection circuit 121 (step S404).

When it is determined as "presence of illuminance" in the process of step S404 (step S404; No), the mode control unit 103 outputs the counting signal CNT indicating the counter reset with respect to the non-illuminance time detection unit 105, and initializes (resets) the counted values of the power saving counter (PSC) 106 and the one-minute counter (1MC) 106A in the non-illuminance time detection unit 105 (step S405). In addition, at that time, the mode control unit 103 turns off the illuminance detection, that is, deactivates the illuminance detection circuit 121 (turns off switch SW1), and stops the output of the illuminance signal.

The process returns to step S401 after the process of step S405, and the mode control unit 103 continues the time point measurement process of the clocking unit 104 and the timepiece display process of the display unit 131.

Meanwhile, when it is determined as "absence of illuminance" in the process of step S404 (step S404; Yes), the mode control unit 103 outputs the counting signal CNT indicating the counted number with respect to the non-illuminance time detection unit 105, and increments (adds +1) the counted value of the power saving counter 106 in the non-illuminance time detection unit 105 (step S406). The non-illuminance time detection unit 105 outputs the counted value of the power saving counter 106 with respect to the mode control unit 103 as a signal showing the non-illuminance duration time NIL. In addition, at that time, the mode control unit 103 turns off the illuminance detection, that is, deactivates (turns off the switch SW1) the illuminance detection circuit 121, and stops the output of the illuminance signal.

Then, when the signal showing the non-illuminance duration time NIL (counted value of the power saving counter 106) is input from the non-illuminance time detection unit 105, the mode control unit 103 determines whether or not the signal indicates the first illuminance detection based on the non-illuminance duration time NIL (initially, 1) (step S407).

When the mode control unit 103 determines that the signal does not indicate the first illuminance detection in the process of step S407 (step S407; No), the process proceeds to the process of step S415 which will be described later.

When it is determined that the illuminance detection is the first time in the process of step S407 (step S407; Yes), the mode control unit 103 continues the time point measurement process of the clocking unit 104 and the time point display process of the display unit 131 (step S408).

After the process of step S408, the mode control unit 103 determines whether or not the current time point is an even-numbered second (step S409). When it is determined that the current time point is not an even-numbered second in the process of step S409 (step S409; No), the process returns to the process of step S408, and the mode control unit 103 continues the time point measurement process of the clocking unit 104 and the time point display process of the display unit 131.

When it is determined that the current time point is an even-numbered second in the process of step S409 (step S409; Yes), the mode control unit 103 turns on the illuminance detection (step S410). That is, the mode control unit 103 turns on and activates the SW1 in the illuminance detection circuit 121 and outputs the illuminance signal from the illuminance detection circuit 121. The illuminance signal is output with respect to the mode control unit 103.

Next, the process proceeds to the process of step S411, and the mode control unit 103 determines whether or not the solar panel 2 is in a state of "absence of illuminance", based on the illuminance signal input from the illuminance detection circuit 121 (step S411).

When it is determined as "presence of illuminance" in the process of step S411 (step S411; No), the mode control unit 103 outputs the counting signal CNT indicating the counter reset with respect to the illuminance time detection unit 105, and initializes (resets) the counted values of the power saving counter (PSC) 106 and the one-minute counter (1MC) 106A in the non-illuminance time detection unit 105 (step S412). In addition, at that time, the mode control unit 103 turns off the illuminance detection.

The process returns to step S401 after the process of step S412, and the mode control unit 103 continues the time point measurement process of the clocking unit 104 and the timepiece display process of the display unit 131.

Meanwhile, when it is determined as "absence of illuminance" in the process of step S411 (step S411; Yes), the mode control unit 103 outputs the counting signal CNT indicating the counted number with respect to the non-illuminance time detection unit 105, and adds 2 (corresponding to two seconds) to the counted value of the one-minute counter (1MC) 106A in the non-illuminance time detection unit 105 (step S413). The non-illuminance time detection unit 105 outputs the counted value of the one-minute counter (1MC) 106A and the counted value of the power saving counter (PSC) 106 with respect to the mode control unit 103, as signals showing the non-illuminance duration time NIL. In addition, at that time, the mode control unit 103 turns off the illuminance detection, that is, deactivates the illuminance detection circuit 121 (turns off switch SW1), and stops the output of the illuminance signal.

The mode control unit 103 determines whether or not one minute is elapsed, based on the counted value of the one-minute counter (1MC) 106A input from the non-illuminance time detection unit 105 (step S414).

When it is determined that one minute is not elapsed in the process of step S414 (step S414; No), the process returns to the process of step S408, and the mode control unit 103 continues the time point measurement process of the clocking unit 104 and the time point display process of the display unit 131.

In addition, when it is determined that one minute is elapsed in the process of step S414 (step S414; Yes), then, the mode control unit 103 determines whether or not 30 minutes is elapsed, based on the non-illuminance duration time NIL (counted value of the power saving counter 106 and the counted value of the one-minute counter (1MC) 106A) (step S415).

When it is determined that 30 minutes is not elapsed in the process of step S415 (step S415; No), the process returns to the process of step S401, and the mode control unit 103 continues the time point measurement process of the clocking unit 104 and the time point display process of the display unit 131. After that, the mode control unit 103 performs the illuminance detection every minute.

In addition, when the mode control unit 103 determines that 30 minutes is elapsed in the process of step S415 (step S415; Yes), the mode control unit 103 transitions the electronic timepiece 1 to the power saving mode (step S416).

Above, the embodiments of the present invention have been described, but, herein, a corresponding relationship between the present invention and the embodiment described above will be described additionally. In the embodiment, the electronic timepiece of the present invention corresponds to the electronic timepiece 1, the solar panel of the present invention corresponds to the solar panel 2, and the secondary battery of the present invention corresponds to the secondary battery 3.

In addition, the first cycle of the present invention corresponds to one minute, and the second cycle of the present invention corresponds to two seconds. The first time and the second time of the present invention correspond to one minute, respectively.

In addition, the control unit of the present invention corresponds to the mode control unit 103, the illuminance detection circuit of the present invention corresponds to illuminance detection circuit 121, the non-illuminance time detection unit of the present invention corresponds to the non-illuminance time detection unit 105, and the display unit of the present invention corresponds to the display unit 131.

In the embodiment, there is an electronic timepiece 1, that includes the solar panel 2 which receives light to generate electric power, is operated with the electric power supplied from the secondary battery 3 charged with output voltage of the solar panel 2, and includes the normal mode in which clock display is performed on the display unit 131 and the power saving mode in which the clock display on the display unit 131 is stopped, based on the illuminance detection of the solar panel 2, the electronic timepiece 1 including: the mode control unit 103 which switches cycles of the illuminance detection, by setting a cycle of the illuminance detection of the normal mode as a first cycle (one minute), and a cycle of the illuminance detection of the power saving mode as a second cycle (two seconds) which is different from the first cycle.

If the electronic timepiece 1 with the configuration described above is provided, in the electronic timepiece 1 including the normal mode and the power saving mode, the cycles of the illuminance detection of the solar panel 2 are switched according to the operation modes. In more detail, after the state where the illuminance is not obtained on the solar panel 2 is detected, the electronic timepiece 1 maintains the normal mode until the transition to the power saving mode, and sets the illuminance detection cycle of the solar panel 2 as the first cycle (one minute), and sets the illuminance detection cycle as the second cycle (two seconds) after the transition to the power saving mode.

Accordingly, after the state where the illuminance is not obtained on the solar panel 2 is detected, it is possible to reduce the electricity consumption for the illuminance detection until the transition to the power saving mode. Thus, it is possible to provide the electronic timepiece 1 capable of reducing the electricity consumption for the illuminance detection of the solar panel 2.

In addition, in the embodiment, in the case of the transition from the normal mode to the power saving mode, the mode control unit 103 performs the illuminance detection with the second cycle (two seconds) for the first predetermined time (for one minute) directly before the transition to the power saving mode.

For example, after the illuminance is not obtained on the solar panel 2, when measuring 30 minutes until the transition to the power saving mode, the electronic timepiece of the configuration described above performs the illuminance detection every two seconds, for the last one minute for the transition to the power saving mode.

Accordingly, in the electronic timepiece 1, directly before the transition to the power saving mode, it is possible to check again for whether or not the illuminance is obtained on the solar panel 2 with high responsiveness. Thus, for example, the electronic timepiece 1 is beneath the shirt sleeve. After 29 minutes has elapsed, and when a user checks the time taking the electronic timepiece 1 from beneath the shirt sleeve in the last one minute, and returns the electronic timepiece 1 to beneath the sleeve again, it is possible to prevent the electronic timepiece 1 from entering the power saving mode immediately, and to avoid feeling of inconvenience for a user.

In addition, in the embodiment, after the state where the illuminance which is equal to or more than a predetermined threshold value is not obtained on the solar panel 2 is detected, the mode control unit 103 performs the illuminance detection of the solar panel 2 with the second cycle (two seconds) for the second predetermined time (one minute), and performs the illuminance detection of the solar panel 2 with the first cycle (one minute) after the second time (one minute) is elapsed.

In the electronic timepiece 1 of the configuration described above, after the illuminance is not obtained on the solar panel 2, the illuminance detection of the solar panel 2 is performed for every second cycle (two seconds) for the first second time (one minute), and the illuminance detection is performed for every first cycle (one minute) after the one minute is elapsed.

Accordingly, for example, it is possible to avoid the transition of the electronic timepiece 1 to the power saving mode, when the electronic timepiece 1 is taken from and returned to beneath the shirt sleeve.

Hereinabove, the embodiment of the present invention has been described, however the electronic timepiece of the present invention is not limited to the examples shown in the drawings described above, and it is needless to say that various modifications can be performed within a range not departing from the scope of the present invention. For example, the example in which the illuminance is detected with second cycle for the first predetermined time directly before the transition to the power saving mode has been described in the second embodiment, and the example in which the illuminance is detected with the second cycle for the second predetermined time after the illuminance is not obtained on the solar panel, has been described in the third embodiment. The electronic timepiece 1 may have a configuration for performing both of the embodiments, rather than the configuration for performing either one thereof.

What is claimed is:

1. An electronic timepiece that includes a solar panel which receives light to generate electric power, is operated with the electric power supplied from a secondary battery charged with output voltage of the solar panel, and includes a normal mode in which clock display is performed on a display unit and a power saving mode in which clock display on the display unit is stopped, based on illuminance detection of the solar panel, the electronic timepiece comprising:

a control unit which switches cycles of the illuminance detection, by setting a cycle of the illuminance detection of the normal mode as a first cycle, and a cycle of the illuminance detection of the power saving mode as a second cycle which is different from the first cycle.

2. The electronic timepiece according to claim 1, wherein the first cycle of the illuminance detection of the normal mode is longer than the second cycle of the illuminance detection of the power saving mode.

3. The electronic timepiece according to claim 2, wherein, in a case of transition from the normal mode to the power saving mode, the control unit performs the illuminance detection with the second cycle in first predetermined time immediately before the transition to the power saving mode.

4. The electronic timepiece according to claim 3, wherein, after a state where illuminance which is equal to or more than a predetermined threshold value is not obtained on the solar panel is detected, the control unit performs the illuminance detection of the solar panel with the second cycle in second predetermined time, and the control unit performs the illuminance detection of the solar panel with the first cycle after the second time is elapsed.

5. The electronic timepiece according to claim 4, further comprising:

an illuminance detection circuit which performs illuminance detection of the solar panel in a cycle; and a non-illuminance time detection unit which measures non-illuminance duration time in which the illuminance is not obtained on the solar panel based on a detection result of the illuminance of the illuminance detection circuit, wherein the control unit controls cycles of the illuminance detection of the illuminance detection circuit, compares the non-illuminance duration time with predetermined transition time, and transitions the electronic timepiece from the normal mode to the power saving mode when the non-illuminance duration time surpasses the transition time.

6. The electronic timepiece according to claim 3, further comprising:

an illuminance detection circuit which performs illuminance detection of the solar panel in a cycle; and a non-illuminance time detection unit which measures non-illuminance duration time in which the illuminance is not obtained on the solar panel based on a detection result of the illuminance of the illuminance detection circuit, wherein the control unit controls cycles of the illuminance detection of the illuminance detection circuit, compares the non-illuminance duration time with predetermined transition time, and transitions the electronic timepiece from the normal mode to the power saving mode when the non-illuminance duration time surpasses the transition time.

7. The electronic timepiece according to claim 2, wherein, after a state where illuminance which is equal to or more than a predetermined threshold value is not obtained on the solar panel is detected, the control unit performs the illuminance detection of the solar panel with the second cycle in second predetermined time, and the control unit performs the illuminance detection of the solar panel with the first cycle after the second time is elapsed.

8. The electronic timepiece according to claim 7, further comprising:

an illuminance detection circuit which performs illuminance detection of the solar panel in a cycle; and a non-illuminance time detection unit which measures non-illuminance duration time in which the illuminance is not obtained on the solar panel based on a detection result of the illuminance of the illuminance detection circuit, wherein the control unit controls cycles of the illuminance detection of the illuminance detection circuit, compares the non-illuminance duration time with predetermined transition time, and transitions the electronic timepiece from the normal mode to the power saving mode when the non-illuminance duration time surpasses the transition time.

9. The electronic timepiece according to claim 2, further comprising:

an illuminance detection circuit which performs illuminance detection of the solar panel in a cycle; and a non-illuminance time detection unit which measures non-illuminance duration time in which the illuminance is not obtained on the solar panel based on a detection result of the illuminance of the illuminance detection circuit, wherein the control unit controls cycles of the illuminance detection of the illuminance detection circuit, compares the non-illuminance duration time with predetermined transition time, and transitions the electronic timepiece from the normal mode to the power saving mode when the non-illuminance duration time surpasses the transition time.

10. The electronic timepiece according to claim 1, wherein, in a case of transition from the normal mode to the power saving mode, the control unit performs the illuminance detection with the second cycle in first predetermined time immediately before the transition to the power saving mode.

11. The electronic timepiece according to claim 10, further comprising:

an illuminance detection circuit which performs illuminance detection of the solar panel in a cycle; and a non-illuminance time detection unit which measures non-illuminance duration time in which the illuminance is not obtained on the solar panel based on a detection result of the illuminance of the illuminance detection circuit, wherein the control unit controls cycles of the illuminance detection of the illuminance detection circuit, compares the non-illuminance duration time with predetermined transition time, and transitions the electronic timepiece from the normal mode to the power saving mode when the non-illuminance duration time surpasses the transition time.

12. The electronic timepiece according to claim 10, wherein, after a state where illuminance which is equal to or more than a predetermined threshold value is not obtained on the solar panel is detected, the control unit performs the illuminance detection of the solar panel with the second cycle in second predetermined time, and the control unit performs the illuminance detection of the solar panel with the first cycle after the second time is elapsed.

13. The electronic timepiece according to claim 12, further comprising:

an illuminance detection circuit which performs illuminance detection of the solar panel in a cycle; and a non-illuminance time detection unit which measures non-illuminance duration time in which the illuminance is not obtained on the solar panel based on a detection result of the illuminance of the illuminance detection circuit, wherein the control unit controls cycles of the illuminance detection of the illuminance detection circuit, compares the non-illuminance duration time with predetermined transition time, and transitions the electronic timepiece from the normal mode to the power saving mode when the non-illuminance duration time surpasses the transition time.

14. The electronic timepiece according to claim 1, wherein, after a state where illuminance which is equal to or more than a predetermined threshold value is not obtained on the solar panel is detected, the control unit performs the illuminance detection of the solar panel with the second cycle in second predetermined time, and the control unit performs the illuminance detection of the solar panel with the first cycle after the second time is elapsed.

15. The electronic timepiece according to claim 14, further comprising:

an illuminance detection circuit which performs illuminance detection of the solar panel in a cycle; and a non-illuminance time detection unit which measures non-illuminance duration time in which the illuminance is not obtained on the solar panel based on a detection result of the illuminance of the illuminance detection circuit, wherein the control unit controls cycles of the illuminance detection of the illuminance detection circuit, compares the non-illuminance duration time with predetermined transition time, and transitions the electronic timepiece from the normal mode to the power saving mode when the non-illuminance duration time surpasses the transition time.

16. The electronic timepiece according to claim 1, further comprising:

an illuminance detection circuit which performs illuminance detection of the solar panel in a cycle; and a non-illuminance time detection unit which measures non-illuminance duration time in which the illuminance is not obtained on the solar panel based on a detection result of the illuminance of the illuminance detection circuit, wherein the control unit controls cycles of the illuminance detection of the illuminance detection circuit, compares the non-illuminance duration time with predetermined transition time, and transitions the electronic timepiece from the normal mode to the power saving mode when the non-illuminance duration time surpasses the transition time.

* * * * *